US009989258B2

(12) United States Patent
Saito et al.

(10) Patent No.: US 9,989,258 B2
(45) Date of Patent: Jun. 5, 2018

(54) PREMIXED-COMBUSTION GAS TURBINE COMBUSTOR

(71) Applicant: MITSUBISHI HITACHI POWER SYSTEMS, LTD., Kanagawa (JP)

(72) Inventors: Keijiro Saito, Tokyo (JP); Satoshi Takiguchi, Tokyo (JP); Toshihiko Saito, Tokyo (JP); Shinji Akamatsu, Tokyo (JP)

(73) Assignee: MITSUBISHI HITACH POWER SYSTEMS, LTD., Kanagawa (JP)

( * ) Notice: Subject to any disclaimer, the term of this patent is extended or adjusted under 35 U.S.C. 154(b) by 473 days.

(21) Appl. No.: 14/438,723

(22) PCT Filed: Oct. 22, 2013

(86) PCT No.: PCT/JP2013/078618
§ 371 (c)(1),
(2) Date: Apr. 27, 2015

(87) PCT Pub. No.: WO2014/069289
PCT Pub. Date: May 8, 2014

(65) Prior Publication Data

US 2015/0300648 A1 Oct. 22, 2015

(30) Foreign Application Priority Data

Oct. 31, 2012 (JP) ..... 2012-240829

(51) Int. Cl.
*F23R 3/28* (2006.01)

(52) U.S. Cl.
CPC ..... *F23R 3/286* (2013.01); *F23R 3/283* (2013.01); *F23R 2900/03042* (2013.01)

(58) Field of Classification Search
CPC ..... F23R 3/286; F23R 2900/03042; F23R 2900/03044; F23R 3/34; F23R 3/343; F23R 3/346
See application file for complete search history.

(56) References Cited

U.S. PATENT DOCUMENTS 6,269,646 B1 8/2001 Lovett et al.
6,301,900 B1 * 10/2001 Mandai ..... F23D 11/107 60/740

(Continued)

FOREIGN PATENT DOCUMENTS

CN 1042599 5/1990
CN 1056563 11/1991

(Continued)

OTHER PUBLICATIONS

Written Opinion of the International Searching Authority dated Jan. 21, 2014 in International (PCT) Application No. PCT/JP2013/078618.

(Continued)

*Primary Examiner* — William H Rodriguez
(74) *Attorney, Agent, or Firm* — Wenderoth, Lind & Ponack, L.L.P.

(57) ABSTRACT

A gas turbine combustor forms a combustion region R1 therein by burning a premixed gas obtained by previously mixing a fuel and combustion air. The gas turbine combustor includes: a burner cylinder (51) in which the premixed gas passes; a film air supply port (61) that is provided on the burner cylinder 51, and supplies a film air formed into a film shape and flowing along the inner wall surface (the inner circumferential surface) of the burner cylinder (51); and a cooling passage (71) in which a cooling air passes. The cooling air cools a back-step surface (65) facing the formed combustion region R1. The cooling passage (71) includes a (Continued)

side from which the cooling air flows out, and the side is connected to the film air supply port (61).

5 Claims, 8 Drawing Sheets

(56) References Cited

U.S. PATENT DOCUMENTS

| | | | | |
|---|---|---|---|---|
| 8,215,950 | B2 * | 7/2012 | Singh | F23R 3/14 431/12 |
| 2010/0101229 | A1 * | 4/2010 | York | F23D 14/62 60/737 |
| 2010/0255435 | A1 * | 10/2010 | Singh | F23R 3/14 431/328 |
| 2010/0293956 | A1 * | 11/2010 | Nadkarni | F23G 5/027 60/748 |
| 2010/0308135 | A1 | 12/2010 | Yamamoto et al. | |
| 2011/0000214 | A1 * | 1/2011 | Helmick | F23D 14/76 60/734 |
| 2012/0186258 | A1 | 7/2012 | Dai et al. | |
| 2013/0219899 | A1 * | 8/2013 | Uhm | F23R 3/14 60/738 |
| 2015/0135718 | A1 * | 5/2015 | Hughes | F23R 3/286 60/738 |
| 2016/0186662 | A1 * | 6/2016 | Stewart | F23R 3/14 239/403 |
| 2017/0122563 | A1 * | 5/2017 | Tanaka | F23R 3/18 |

FOREIGN PATENT DOCUMENTS

| | | |
|---|---|---|
| CN | 1875223 | 12/2006 |
| CN | 101349425 | 1/2009 |
| CN | 101839483 | 9/2010 |
| JP | 2954480 | 7/1999 |
| JP | 2000-146183 | 5/2000 |
| JP | 2005-114193 | 4/2005 |
| JP | 2005-345094 | 12/2005 |
| JP | 4070758 | 1/2008 |
| JP | 2010-101309 | 5/2010 |
| JP | 2010-281483 | 12/2010 |
| JP | 2012-154618 | 8/2012 |

OTHER PUBLICATIONS

International Search Report dated Jan. 21, 2014 in International (PCT) Application No. PCT/JP2013/078618.

Office Action dated Jun. 7, 2016 in corresponding Japanese Application No. 2012-240829, with English translation.

Notification of Grant of Invention Patent and Notification of Completion of Formalities for Registration dated Jul. 1, 2016 in corresponding Chinese Application No. 201380056168.8, with English translation.

Office Action dated Nov. 19, 2015 in Chinese Application No. 201380056168.8, with English translation.

Notice of Allowance dated Aug. 29, 2016 in Korean Application No. 10-2015-7010871, with English translation.

Decision of a Patent Grant dated Aug. 23, 2016 in corresponding Japanese Application No. 2012-240829 (with English translation).

* cited by examiner

PREMIXED-COMBUSTION GAS TURBINE COMBUSTOR

FIELD

The present invention relates to a premixed-combustion gas turbine combustor and a gas turbine including the gas turbine combustor.

BACKGROUND

There are conventionally known premixed-combustion gas turbine combustors that previously mix the fuel with combustion air and then burn the premixed gas (for example, see Patent Literature 1). The gas turbine combustor includes a main burner in which the premixed gas passes. The main burner includes a burner external cylinder and an extension pipe placed downstream of the burner external cylinder. Burning the premixed gas from the main burner generates flashback that is a phenomenon of a backfire (combustion) in the main burner. In light of the foregoing, to prevent the generation of flashback, an air formed into a film shape (the film air) flows from the gap between the burner external cylinder and the extension pipe and along the inner wall surface of the extension pipe.

CITATION LIST

Patent Literature

Patent Literature 1: Japanese Patent No. 4070758

SUMMARY

Technical Problem

By the way, the air taken in the gas turbine combustor is distributed as the cooling air in addition to as the combustion air and the film air described above. At that time, the amount of air to be taken in the gas turbine combustor is prescribed in accordance with the output performance of the gas turbine. Thus, using a large amount of the air as the film air and the cooling air reduces the amount of air to be used as the combustion air. Meanwhile, the fuel component in the premixed gas increases. This makes it difficult to reduce the NOx generated in the combustion.

In light of the foregoing, an objective of the present invention is to provide a gas turbine combustor and a gas turbine that can reduce NOx generated in the combustion while preventing flashback.

Solution to Problem

According to an aspect of the present invention, a gas turbine combustor that forms therein a combustion region by burning a premixed gas obtained by mixing a fuel and combustion air in advance, comprises: a premixed gas supply passage in which the premixed gas passes; a film air supply port that is provided on the premixed gas supply passage and that supplies a film air formed into a film shape along an inner wall surface of the premixed gas supply passage; and a cooling passage in which a cooling air passes to cool the inner wall surface facing the combustion region formed. An outlet side of the cooling passage is connected to the film air supply port.

The configuration can use the cooling air as the film air, and thus can reduce the amount of air to be used in comparison with the case in which separate airs are used for the cooling air and the film air. The reduction can increase the amount of air to be used as the fuel air. The increase can decrease the concentration of the fuel component in the premixed gas. This can cool the inner wall surface in the combustion chamber while preventing the flashback, and can reduce NOx generated by the combustion of the premixed gas.

Advantageously, in the gas turbine combustor, the cooling passage is formed along an inner surface opposing to the combustion region across the inner wall surface.

The configuration enables the cooling air to pass along the inner surface, and thus can cool the inner wall surface preferably.

Advantageously, in the gas turbine combustor, an impingement member is inserted in the cooling passage and the impingement member includes an impingement hole penetrating the impingement member such that the cooling air is injected onto the inner surface.

This configuration enables the cooling air passing through the cooling passage to jet from the impingement member and hit the inner surface by causing the cooling air to pass through the impingement member. Thus, the configuration can cool the inner wall surface facing the combustion region preferably. Meanwhile, the configuration can accelerate the flow rate of air after the air passes through the impingement hole, and thus can improve the efficiency of cooling the inner surface. This can reduce the amount of air to be used as the cooling air.

Advantageously, in the gas turbine combustor, the film air supply port is an opening formed between the inner wall surface on an upstream side of the premixed gas supply passage and the inner wall surface on a downstream side provided outside the inner wall surface on the upstream side.

The configuration enables the film air supplied from the film air supply port to pass along the inner wall surface of the premixed gas supply passage preferably.

Advantageously, in the gas turbine combustor, the film air supply port is a slit opening formed on the inner wall surface of the premixed gas supply passage.

The configuration can supply the film air supplied from the film air supply port from the inner wall surface of the premixed gas supply passage, thus can use the inner wall surface as a plane.

According to another aspect of the present invention, a gas turbine comprises: any one of the above gas turbine combustors; and a turbine that rotates by a combustion gas generated by combustion of the premixed gas in the gas turbine combustor.

The configuration can rotate the turbine in low NOx combustion while preventing flashback.

DESCRIPTION OF EMBODIMENTS

The embodiments according to the present invention will be described in detail hereinafter with reference to the appended drawings. Note that the present invention is not limited to the embodiments. Furthermore, the components in the embodiments include things that a person skilled in the art can replace and that are simple, or things that are substantially the same as the components.

First Embodiment

Figure 1:
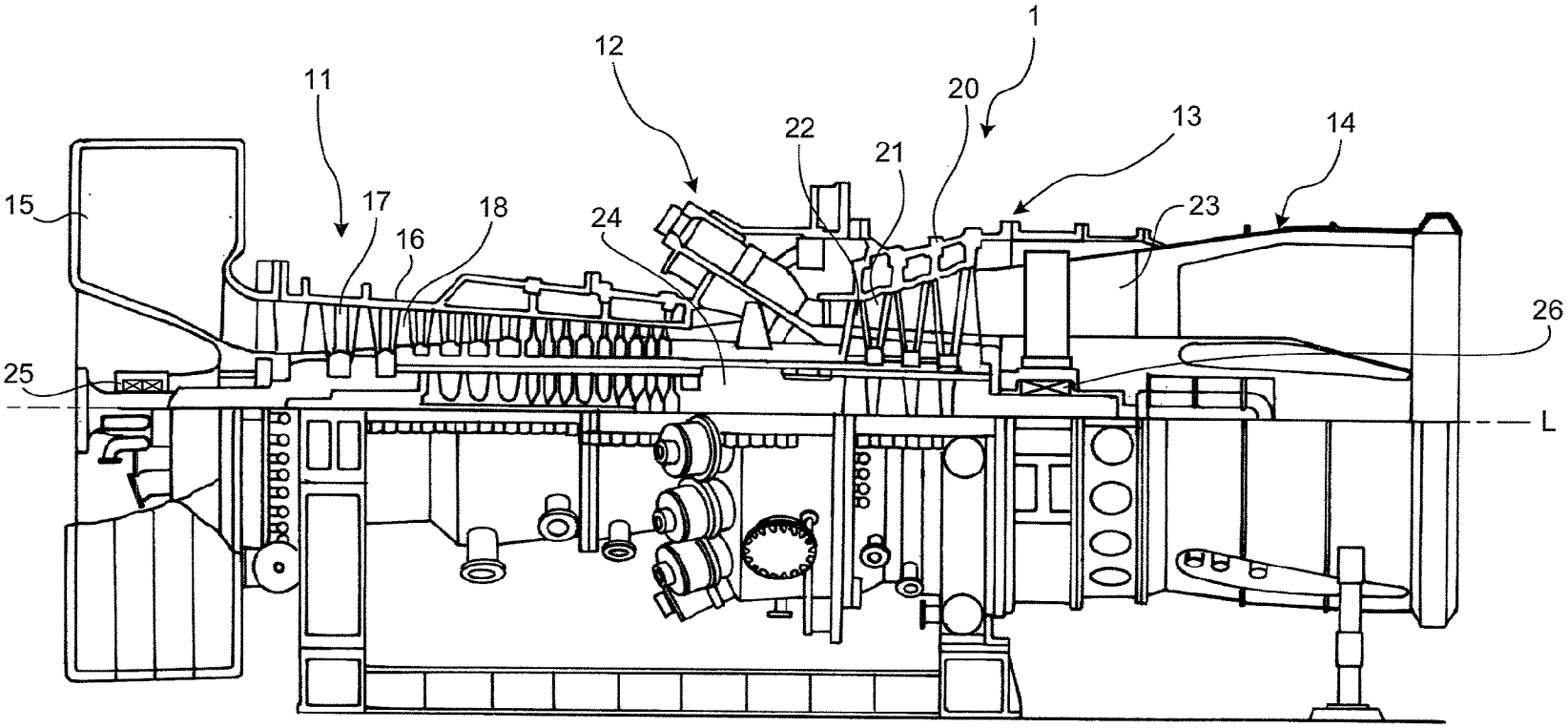
FIG. 1 is a schematic diagram of the configuration of a gas turbine according to a first embodiment.

FIG. 1 is a schematic diagram of the configuration of a gas turbine according to the first embodiment. As illustrated in FIG. 1, the gas turbine 1 includes a compressor 11, a gas turbine combustor (hereinafter, referred to as a combustor) 12, a turbine 13, and a exhaust chamber 14. An electric generator (not illustrated) is connected to the turbine 13.

The compressor 11 includes an air inlet 15 for taking air in, and a compressor casing 16 in which a plurality of compressor vanes 17 and turbine blades 18 are alternately arranged. The combustor 12 can burn the air compressed in the compressor 11 (the combustion air) by supplying the fuel to the air and then igniting the air with the burner. The turbine 13 includes a plurality of turbine vanes 21 and turbine blades 22 that are alternately arranged in a turbine casing 20. The exhaust chamber 14 includes a exhaust diffuser 23 continuously connected to the turbine 13. A rotor (turbine shaft) 24 penetrates the central portions of the compressor 11, the combustor 12, the turbine 13, and the exhaust chamber 14. The end of the rotor 24 on the side of the compressor 11 is rotatably supported at a bearing portion 25 while the end of the rotor 24 on the side of the exhaust chamber 14 is rotatably supported at a bearing portion 26. Furthermore, a plurality of disk plates are fixed on the rotor 24 so as to connect each of the turbine blades 18 and 22 to the disk plate. A driving shaft of an electric generator (not illustrated) is connected to the end of the rotor 24 on the side of the exhaust chamber 14.

The air taken from the air inlet 15 of the compressor 11 is compressed and becomes a compressed air with a high temperature and a high pressure while passing through the compressor vanes 21 and the turbine blades 22. Then, the compressed air burns with a predetermined fuel supplied thereto in the combustor 12. Combustion gas with a high temperature and a high pressure is generated in the combustor 12 as a working fluid. Subsequently, the combustion gas drives and rotates the rotor 24 by passing through the turbine vanes 21 and turbine blades 22 included in the turbine 13. This rotation drives the electric generator connected to the rotor 24. On the other hand, the exhausted gas that is the combustion gas after driving and rotating the rotor 24 is discharged to the air after the pressure of the exhausted gas is transformed into a static pressure in the exhaust diffuser 23 of the exhaust chamber 14.

Figure 2:
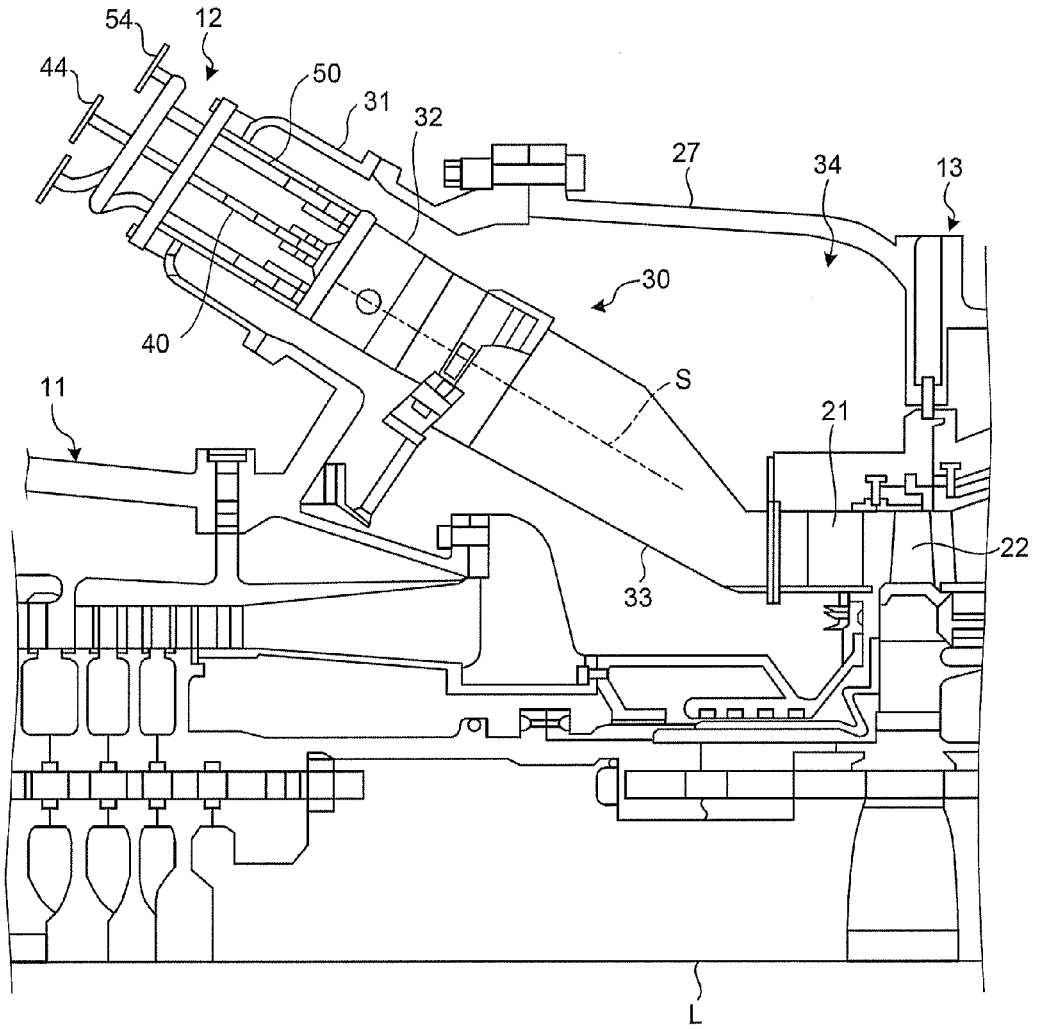
FIG. 2 is an enlarged view of a gas turbine combustor in FIG. 1.

FIG. 2 is an enlarged view of the gas turbine combustor in FIG. 1. The combustor 12 includes a combustor casing 30. The combustor casing 30 includes an inner cylinder 32 placed in an external cylinder 31, and a transition piece 33 connected to the top end portion of the inner cylinder 32. The combustor casing 30 extends along a central axis S inclined from a rotation axis L of the rotor 24.

The external cylinder 31 is fastened to the casing housing 27 forming a casing 34 to which the compressed air flows from the compressor 11. The base end portion of the inner cylinder 32 is supported with the external cylinder 31. The inner cylinder 32 is placed inside the external cylinder 31, leaving a predetermined space from the external cylinder 31. A pilot burner 40 is provided along the central axis S at the central portion of the inner cylinder 32. A plurality of main burners 50 are arranged at regular intervals around the pilot burner 40, surrounding the pilot burner 40 and being parallel to the pilot burner 40. The base end of the transition piece 33 is formed into a cylindrical shape and is connected to the top end of the inner cylinder 32. The transition piece 33 is formed into a curved shape while the cross-sectional area decreases toward the top end of the transition piece 33. The transition piece 33 includes an opening that opens toward a first turbine vane 21 in the turbine 13. The transition piece 33 includes a combustion chamber therein.

Figure 3:
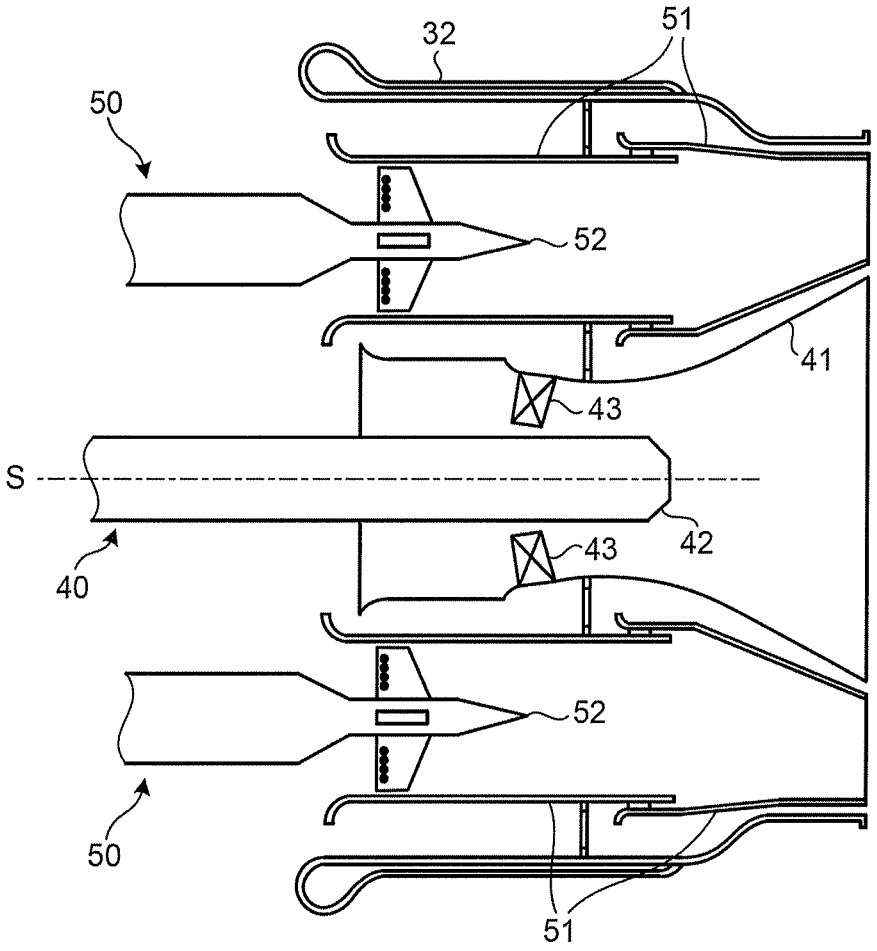
FIG. 3 is a schematic diagram of the internal configuration of the gas turbine combustor.

FIG. 3 is a schematic diagram of the internal configuration of the gas turbine combustor. The pilot burner 40 includes a pilot cone 41, a pilot nozzle 42 placed along the central axis S in the pilot cone 41, and pilot swirlers 43 provided at the outer periphery of the pilot nozzle 42. Each of the main burners 50 includes a burner cylinder 51, and a main nozzle 52 placed in the burner cylinder 51 and parallel to the central axis S. The fuel is supplied to the pilot nozzle 42 through the fuel port 44 (in FIG. 2) from a pilot combustion line (not illustrated). The fuel is supplied to the main nozzle 52 through the fuel port 54 (in FIG. 2) from a main fuel line (not illustrated).

As illustrated in FIG. 2, the compressed air with a high temperature and a high pressure from the compressor 11 flows into the casing 34 around the combustor 12. The compressed air flows outside the transition piece 33 and the inner cylinder 32 in the direction from the transition piece 33 to the inner cylinder 32 and then flows into the inside of the inner cylinder 32 from the base end of the inner cylinder 32. After flowing into the inner cylinder 32, the compressed air is mixed with the fuel and burns in the pilot burner 40 and the main burner 50, and then becomes the combustion gas.

In other words, the compressed air that has flown into the inner cylinder 32 is mixed with the fuel ejected from the main nozzle 52. The mixed air forms a swirling flow of the premixed gas and flows into the transition piece 33 from the burner cylinder 51. Thus, the burner cylinder 51 functions as a premixed gas supply passage for supplying the premixed gas toward the transition piece 33. Separately from the premixed gas, the compressed air that has flown into the inner cylinder 32 is swirled with the pilot swirler 43 and then is mixed with the fuel ejected from the pilot nozzle 42 and becomes a premixed gas. The premixed gas flows into the transition piece 33. The premixed gas from the pilot nozzle 42 is ignited with a pilot light (not illustrated) and burns. After that, the premixed gas becomes the combustion gas and jets into the transition piece 33. At that time, a part of the combustion gas jets with flame in the transition piece 33 while diffusing. This ignites and burns the premixed gas that has flown in the transition piece 33 from the burner cylinder 51 in each of the main burners 50.

As described above, the diffusion flame with the fuel ejected from the pilot nozzle 42 can stabilize the flame for stably burning the lean premixed fuel from the main nozzle 52. The premix of the fuel from the main nozzle 52 and the compressed air in the main burner 50 equalizes the concentration of the fuel. This equalization can reduce NOx.

Figure 4:
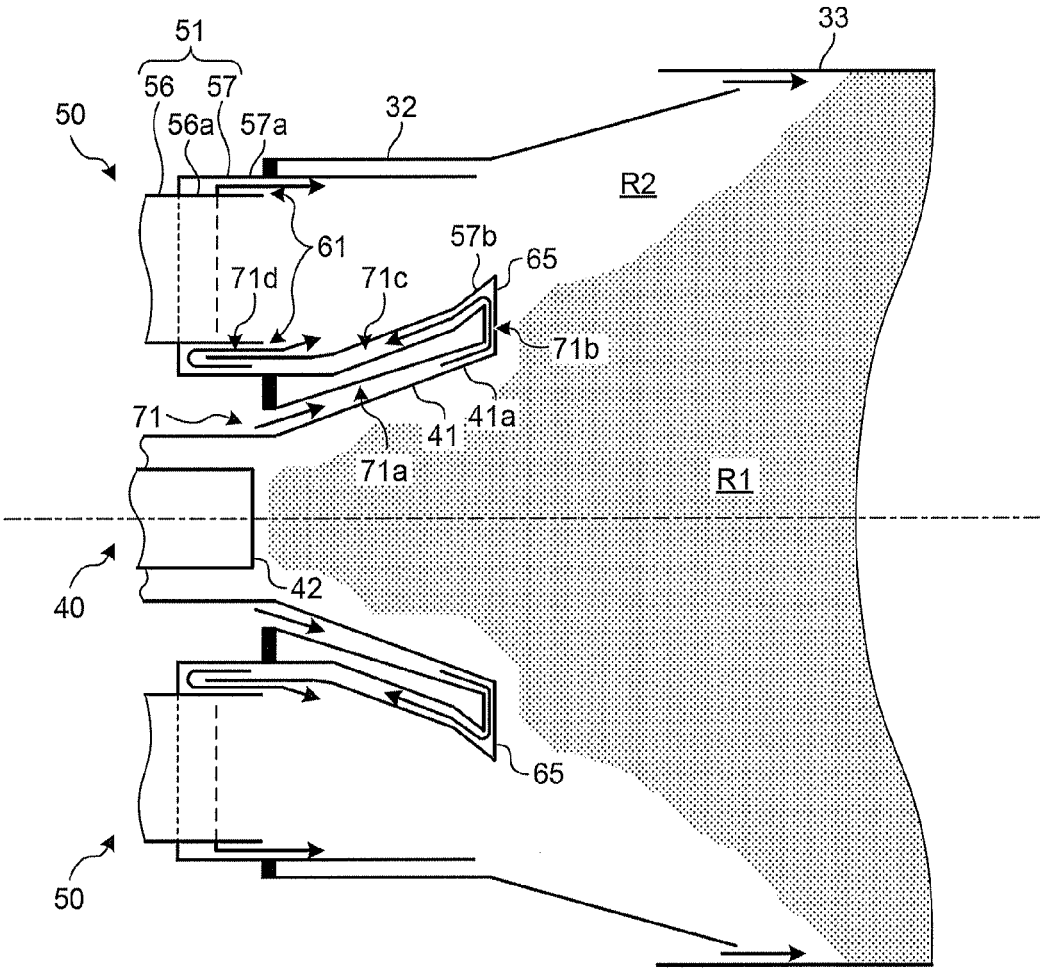
FIG. 4 is a schematic diagram of the configuration around a cooling passage of a pilot cone.

FIG. 4 is a schematic diagram of the configuration around the cooling passage of the pilot cone. As illustrated in FIG. 4, an unburned gas region R2 in which the premixed gas does not burn includes the inside of the main burner 50. A combustion region R1 in which the premixed gas burns lies downstream of the pilot nozzle 42, and includes the inside of the pilot cone 41 and the inside of the transition piece 33. Thus, the combustion gas that is the burned premixed gas flows in the transition piece 33. As described above, the combustion region R1 is formed from the inside of the inner cylinder 32 to the inside of the transition piece 33.

By the way, in such a premix combustor 12, the flow rate of the premixed gas flowing in the burner cylinder 51 decreases downstream of the main nozzle 52 and on the side of the inner wall surface of the burner cylinder 51. The combustion in the combustion region R1 expands toward the premixed gas at the decreasing speed. This expansion facilitates backfire (flashback) from the combustion region R1 to the unburned gas region R2. In light of the foregoing, to prevent the flashback from the combustion region R1 to the unburned gas region R2, a film air is supplied to the burner cylinder 51 of the main burner 50 along the inner wall surface of the burner cylinder 51.

Additionally, the combustion increases the temperature in the combustion region R1. Thus, the inner wall surface facing the combustion region R1 needs to be cooled. Specifically, the inner wall surface facing the combustion region R1 includes the inner wall surface of the pilot cone 41 and a back-step surface 65 to be described below. To cool the inner wall surface of the pilot cone 41 and the back-step surface 65, the cooling air is supplied in the pilot cone 41.

As described above, the air taken from the air inlet 15 in the compressor 11 is used as the combustion air, the film air, and the cooling air. In such a case, the amount of air to be taken in is prescribed in accordance with the output performance of the gas turbine 1. Thus, using a large amount of the air as the film air and the cooling air reduces the amount of air to be used as the combustion air. In light of the foregoing, the first embodiment includes the configuration to be described below in order to prevent the decrease in the amount of air to be used as the combustion air. The configuration around the pilot cone 41 and the burner cylinder 51 will be described hereinafter with reference to FIG. 4.

As illustrated in FIG. 4, the burner cylinder 51 includes a first burner cylinder 56 and a second burner cylinder 57. A top end portion 56*a* of the first burner cylinder 56 extends beyond the main nozzle 52 and to the downstream side of the direction in which the premixed gas flows. A base end portion 57*a* of the second burner cylinder 57 is placed outside the top end portion 56*a*, covering the top end portion 56*a* and leaving a space from the top end portion 56*a* circumferentially. In other words, the inner circumferential surface of the base end portion 57*a* of the second burner cylinder 57 has a diameter larger than that of the outer circumferential surface of the top end portion 56*a* of the first burner cylinder 56. A circular opening is formed between the outer circumferential surface of the first burner cylinder 56 and the inner circumferential surface of the second burner cylinder 57. The circular opening works as a film air supply port 61 that supplies the film air. The pilot cone 41 is formed into a tapered shape while the top end portion 41*a* is enlarged toward the downstream side of the direction in which the premixed gas flows.

The top end portion 41*a* on the inner circumferential surface (the inner wall surface) of the pilot cone 41 is connected to the top end portion 57*b* on the inner circumferential surface of the second burner cylinder 57 (the burner cylinder 51) through the back-step surface 65. The back-step surface 65 is perpendicular to the central axis S and faces the combustion region R1.

The pilot cone 41 includes a cooling passage 71 in which the cooling air flows. The cooling passage 71 is formed between the outer circumferential surface of the pilot cone 41 and the outer circumferential surface of the burner cylinder 51. A first end of the cooling passage 71 is connected to the casing 34 in which the compressed air flows. A second end of the cooling passage 71 is connected to the film air supply port 61. The cooling passage 71 includes an upstream cooling passage 71*a*, a midstream cooling passage 71*b*, a downstream cooling passage 71*c*, and a film air supply passage 71*d*.

The upstream cooling passage 71*a* lies along the outer circumferential surface of the pilot cone 41 such that the cooling air flows therein from the base end to top end of the pilot cone 41. The midstream cooling passage 71*b* lies along the surface (inner surface) of the inside (the opposite side) of the back-step surface 65 such that the cooling air flows therein from the pilot cone 41 to each of the second burner cylinders 57. The downstream cooling passage 71*c* lies along the outer circumferential surface of the second burner cylinder 57 such that the cooling air flows from the top end to base end of the second burner cylinder 57. The film air supply passage 71*d* is a cooling passage that lies between the outer circumferential surface of the first burner cylinder 56 and the inner circumferential surface of the second burner cylinder 57 such that the cooling air flows therein from the base end to top end of the second burner cylinder 57 and then the cooling air is discharged from the film air supply port 61.

A part of the compressed air in the casing 34 flows as the cooling air into the cooling passage 71 having the configuration described above. The cooling air flows along the outer circumferential surface of the pilot cone 41 by flowing in the upstream cooling passage 71*a*. The flow cools the inner circumferential surface of the pilot cone 41. After that, the cooling air flows along the inner surface of the back-step surface 65 by flowing in the midstream cooling passage 71*b*. The flow cools the back-step surface 65. Then, the cooling air flows along the outer circumferential surface of the second burner cylinder 57 by flowing in the downstream cooling passage 71*c*. The flow cools the inner circumferential surface of the second burner cylinder 57. Thus, the cooling air flows in the upstream cooling passage 71*a* in the opposite direction to the direction in which the cooling air flows in the downstream cooling passage 71*c*. Subsequently, the cooling air flows along the inner circumferential surface of the second burner cylinder 57 by flowing in the film air supply passage 71*d*. This flow discharges the cooling air as the film air from the film air supply port 61.

After being discharged from the film air supply port 61, the film air flows along the inner circumferential surface of the second burner cylinder 57 and joins the premixed gas flowing in the second burner cylinder 57 downstream of the film air supply port 61.

As described above, the configuration enables the first embodiment to use the cooling air as the film air. The usage can reduce the amount of air to be used in comparison with the case in which separate airs are used for the cooling air and the film air. The reduction can increase the amount of air to be used as the fuel air. The increase can decrease the concentration of the fuel component in the premixed gas. This can cool the surface facing the combustion region R1, namely, the back-step surface 65 and the like while preventing the flashback and can reduce NOx generated by the combustion of the premixed gas.

Second Embodiment

Figure 5:
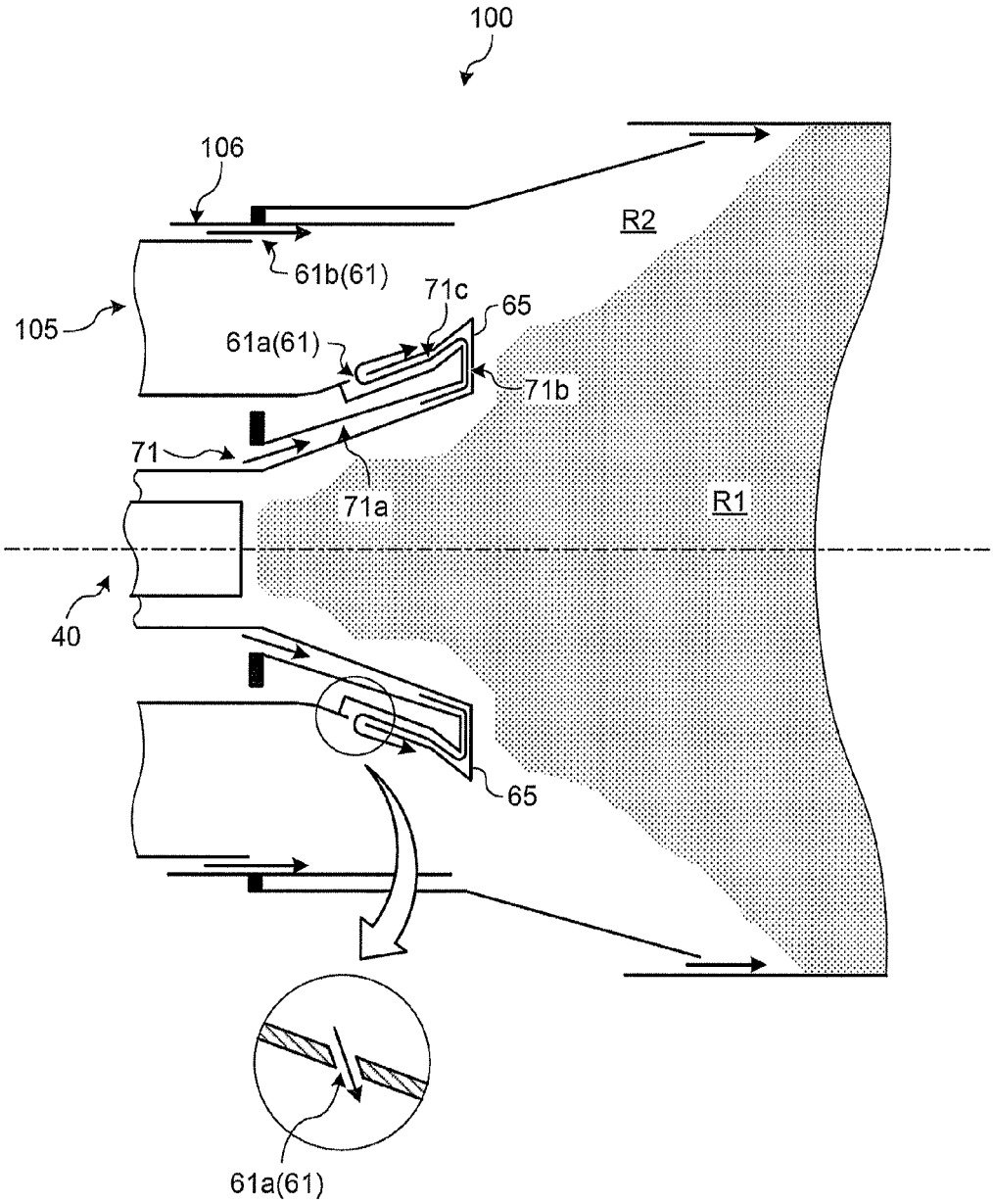
FIG. 5 is a schematic diagram of the configuration around a cooling passage of a pilot cone in a gas turbine combustor according to a second embodiment.

A gas turbine combustor 100 according to the second embodiment will be described next with reference to FIG. 5. FIG. 5 is a schematic diagram of the configuration around the cooling passage of the pilot cone of the gas turbine combustor according to the second embodiment. Note that only the components different from the first embodiment will be described in the second embodiment in order to avoid the description overlapping with the description in the first embodiment. The gas turbine combustor 12 in the first embodiment is provided with the main burners 50 around the pilot burner 40. On the other hand, the gas turbine combustor in the second embodiment is an annular combustor that is provided with a circular main burner 105 around the pilot burner 40.

As illustrated in FIG. 5, the gas turbine combustor 100 according to the second embodiment is provided with the circular main burner 105 around the pilot burner 40. Thus, the film air flows along both the inside inner circumferential surface of the main burner 105 and the outside inner circumferential surface facing the inside inner circumferential surface of the main burner 105. Thus, a film air supply port 61 includes an inside film air supply port 61*a* provided on the inside inner circumferential surface and an outside film air supply port 61*b* provided on the outside inner circumferential surface. The inside film air supply port 61*a* is a slit opening that opens on the inner circumferential surface of a circular burner cylinder 106 and is formed into a slit shape. The inside film air supply port 61*a* that is a slit opening is inclined from the upstream side to downstream side of the burner cylinder 106.

A cooling passage 71 that cools a pilot cone 41 of a pilot burner 40 is connected to the inside film air supply port 61*a*. On the other hand, the outside film air supply port 61*b* is connected to the casing 34. Thus, the cooling passage 71 includes an upstream cooling passage 71*a*, a midstream cooling passage 71*b*, and a downstream cooling passage 71*c*. Note that the upstream cooling passage 71*a*, the midstream cooling passage 71*b*, and the downstream cooling passage 71*c* are similar to those in the first embodiment. At that time, the inside film air supply port 61*a* is connected to the downstream cooling passage 71*c*.

A part of the compressed air in the casing 34 flows as the cooling air into the cooling passage 71 having the configuration described above. The cooling air flows along the outer circumferential surface of the pilot cone 41 by flowing in the upstream cooling passage 71*a*. The flow cools the inner circumferential surface of the pilot cone 41. After that, the cooling air flows along the inner surface of the back-step surface 65 by flowing in the midstream cooling passage 71*b*. The flow cools the back-step surface 65. Then, the cooling air flows along the inside of the burner cylinder 106 by flowing in the downstream cooling passage 71*c*. This flow cools the inside inner circumferential surface of the burner cylinder 106. Thus, the cooling air flows in the upstream cooling passage 71*a* and the downstream cooling passage 71*c* in the opposite direction to the direction in which the cooling air flows in the upstream cooling passage 71*a*. Subsequently, the cooling air is discharged as the film air from the inside film air supply port 61*a* connected to the downstream cooling passage 71*c*.

The film air discharged from the inside film air supply port 61*a* flows along the inside inner circumferential surface of the burner cylinder 106 and joins the premixed gas flowing in the burner cylinder 106 downstream the inside film air supply port 61*a*.

As described above, the configuration in the second embodiment can use the cooling air as the film air even in an annular combustor. The usage can reduce the amount of air to be used in comparison with the case in which separate airs are used for the cooling air and the film air. The reduction can increase the amount of air to be used as the fuel air. The increase can decrease the concentration of the fuel component in the premixed gas. This can cool the surface facing the combustion region R1, namely, the back-step surface 65 and the like while preventing the flashback and can reduce NOx generated by the combustion of the premixed gas.

Third Embodiment

Figure 6:
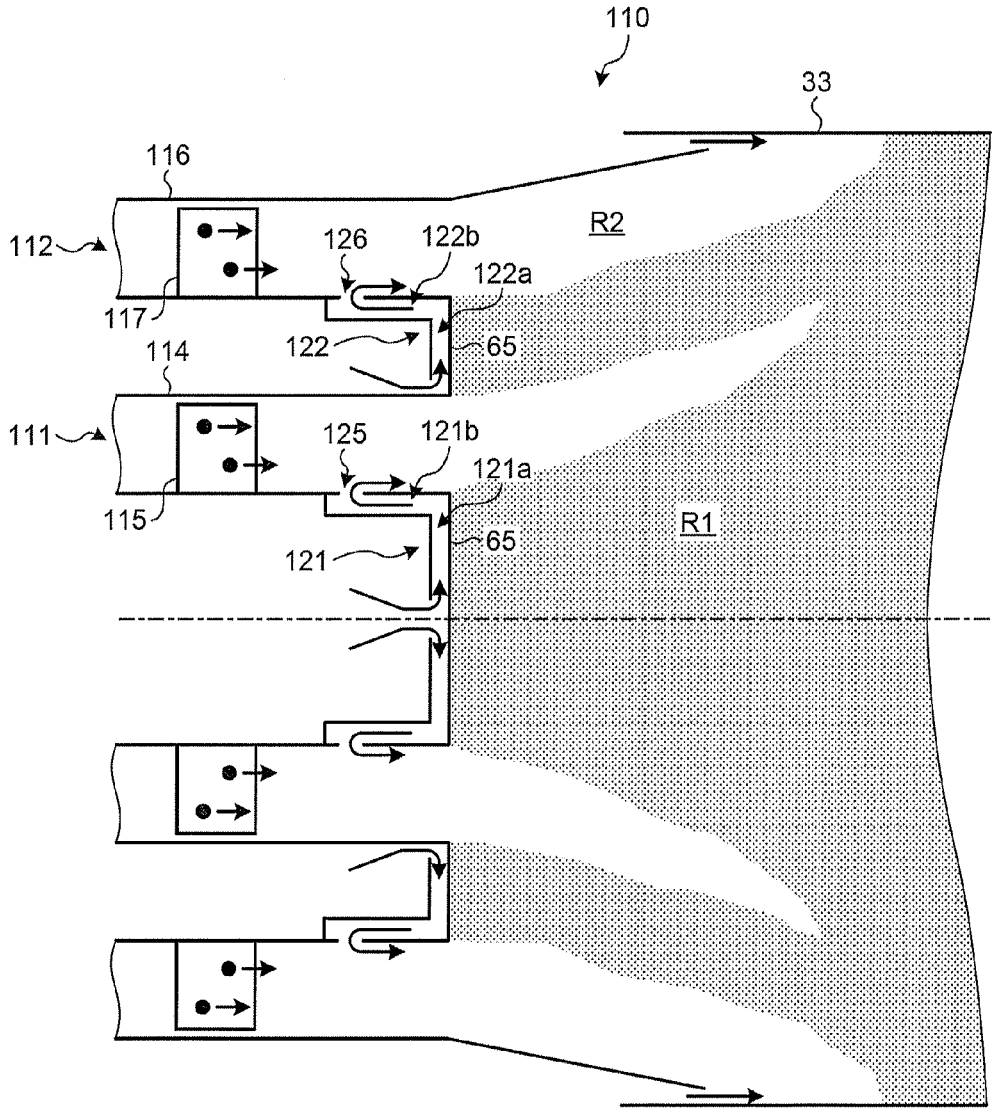
FIG. 6 is a schematic diagram of the configuration around a cooling passage of a burner in a gas turbine combustor according to a third embodiment.

A gas turbine combustor 110 according to the third embodiment will be described next with reference to FIG. 6. FIG. 6 is a schematic diagram around the cooling passage of the burner of the gas turbine combustor according to the third embodiment. Note that only the components different from the first embodiment will be described also in the third embodiment in order to avoid the description overlapping with the description in the first embodiment. The gas turbine combustor 12 in the first embodiment is provided with the main burners 50 around the pilot burner 40. On the other hand, the gas turbine combustor 110 in the third embodiment is provided, around a central axis S, with an inside burner 111 that is the inner circle and an circular outside burner 112 provided at the outer periphery of the inside burner 111.

As illustrated in FIG. 6, in the gas turbine combustor 110 in the third embodiment, the inside burner 111 includes a circular inside cylinder 114 and an inside fuel nozzle 115 provided inside the inside cylinder 114. The outside burner 112 includes a circular outside cylinder 116 and an outside fuel nozzle 117 provided inside the outside cylinder 116. The fuel is supplied to the inside fuel nozzle 115 and the outside fuel nozzle 117 through a combustion line (not illustrated). Each of the inside fuel nozzle 115 and the outside fuel nozzle 117 functions as a swirler for generating a swirling flow.

The compressed air flows into the inside cylinder 114 of the inside burner 111. After flowing in the inside cylinder 114, the compressed air is mixed with the fuel ejected from the inside fuel nozzle 115, and then flows as the swirling flow of the premixed gas into the transition piece 33 from the inside cylinder 114. Thus, the inside cylinder 114 functions as a premixed gas supply passage for supplying the premixed gas toward the transition piece 33. Separately from the compressed air, the compressed air flows into the outside cylinder 116 of the outside burner 112. After flowing in the outside cylinder 116, the compressed air is mixed with the fuel ejected from the outside fuel nozzle 117, and flows as the swirling flow of the premixed gas from the outside cylinder 116 into the transition piece 33. Thus, the outside cylinder 116 also functions as a premixed gas supply passage for supplying the premixed gas toward the transition piece 33. The premixed gas from the inside cylinder 114 of the inside burner 111 is ignited with a pilot light (not illustrated) and burns. Then, the premixed gas becomes the combustion gas and jets into a transition piece 33. At that time, a part of the combustion gas jets with flame in the transition piece 33 while diffusing. This ignites and burns the premixed gas flown in the transition piece 33 from the outside cylinder 116 of the outside burner 112.

As illustrated in FIG. 6, an unburned gas region R2 in which the premixed gas does not burn is formed on the downstream sides of the inside cylinder 114 and the outside cylinder 116. A combustion region R1 in which the premixed gas burns includes a region from the downstream side of the back-step surface 65 inside the inside cylinder 114 to the inside of the transition piece 33, and a region from the downstream side of the back-step surface 65 between the inside cylinder 114 and the outside cylinder 116 to the inside of the transition piece 33.

In the combustor 110 described above, the film air flows along the inner circumferential surface inside the inside cylinder 114 of the inside burner 111, and the inner circumferential surface inside the outside cylinder 116 of the outside burner 112. Thus, an inside film air supply port 125 is provided on the inner circumferential surface inside the inside cylinder 114, and an outside film air supply port 126 is provided on the inner circumferential surface inside the outside cylinder 116. The inside film air supply port 125 is a slit opening that opens on the inner circumferential surface inside the circular inside cylinder 114 and is formed into a slit shape. The outside film air supply port 126 is also a slit opening that opens on the inner circumferential surface inside the circular outside cylinder 116 and is formed into a slit shape.

An inside cooling passage 121 that cools the back-step surface 65 inside the inside cylinder 114 is connected to the inside film air supply port 125. An outside cooling passage 122 that cools the back-step surface 65 between the inside cylinder 114 and the outside cylinder 116 is connected to the outside film air supply port 126.

The inside cooling passage 121 includes an upstream inside cooling passage 121*a*, and a downstream inside cooling passage 121*b*. The upstream inside cooling passage 121*a* lies along the surface (inner surface) of the inside (the opposite side) of the back-step surface 65 inside the inside cylinder 114 such that the cooling air flows therein from the central axis S to the inside cylinder 114. The downstream inside cooling passage 121*b* lies along the surface (inner surface) of the inside (the opposite side) of the inner circumferential surface inside the inside cylinder 114 such that the cooling air flows therein from the top end to base end of the inside cylinder 114. In that case, the inside film air supply port 125 is connected to the downstream inside cooling passage 121*b*.

The outside cooling passage 122 includes an upstream outside cooling passage 122*a* and a downstream outside cooling passage 122*b*. The upstream outside cooling passage 122*a* lies along the surface (inner surface) of the inside (the opposite side) of the back-step surface 65 between the inside cylinder 114 and the outside cylinder 116 such that the cooling air flows therein from the inside cylinder 114 to the outside cylinder 116. The downstream outside cooling passage 122*b* lies along the surface (inner surface) of the inside (the opposite side) of the inner circumferential surface inside the outside cylinder 116 such that the cooling air flows therein from the top end to base end of the outside cylinder 116. In that case, the outside film air supply port 126 is connected to the downstream outside cooling passage 122*b*.

A part of the compressed air in the casing 34 flows as the cooling air into the inside cooling passage 121 and the outside cooling passage 122 described above. In the inside cooling passage 121, the cooling air flows along the inner surface of the back-step surface 65 inside the inside cylinder 114 by flowing in the upstream inside cooling passage 121*a*. The flow cools the back-step surface 65. The cooling air flows along the inner surface of the inside cylinder 114 by flowing in the downstream inside cooling passage 121*b*. The flow cools the inner circumferential surface inside the inside cylinder 114. Subsequently, the cooling air is discharged as the film air from the inside film air supply port 125 connected to the downstream inside cooling passage 121*b*. Similarly, in the outside cooling passage 122, the cooling air flows along the inner surface of the back-step surface 65 between the inside cylinder 114 and the outside cylinder 116 by flowing in the upstream outside cooling passage 122*a*. The flow cools the back-step surface 65. The cooling air flows along the inner surface of the outside cylinder 116 by flowing in the downstream outside cooling passage 122*b*. The flow cools the inner circumferential surface inside the outside cylinder 116. Subsequently, the cooling air is discharged as the film air from the outside film air supply port 126 connected to the downstream outside cooling passage 122*b*.

After being discharged from the inside film air supply port 125, the film air flows along the inner circumferential surface inside the inside cylinder 114, and joins the premixed gas flowing in the inside cylinder 114 downstream of the inside film air supply port 125. After being discharged from the outside film air supply port 126, the film air flows along the inner circumferential surface inside the outside cylinder 116, and joins the premixed gas flowing in the outside cylinder 116 downstream of the outside film air supply port 126.

As described above, the gas turbine combustor 110 having the configuration according to the third embodiment can also use the cooling air as the film air. The usage can reduce the amount of air to be used in comparison with the case in which separate airs are used for the cooling air and the film air. The reduction can increase the amount of air to be used as the fuel air. The increase can decrease the concentration of the fuel component in the premixed gas. This can cool the surface facing the combustion region R1, namely, the back-step surface 65 and the like while preventing the flashback and can reduce NOx generated by the combustion of the premixed gas.

Figure 7:
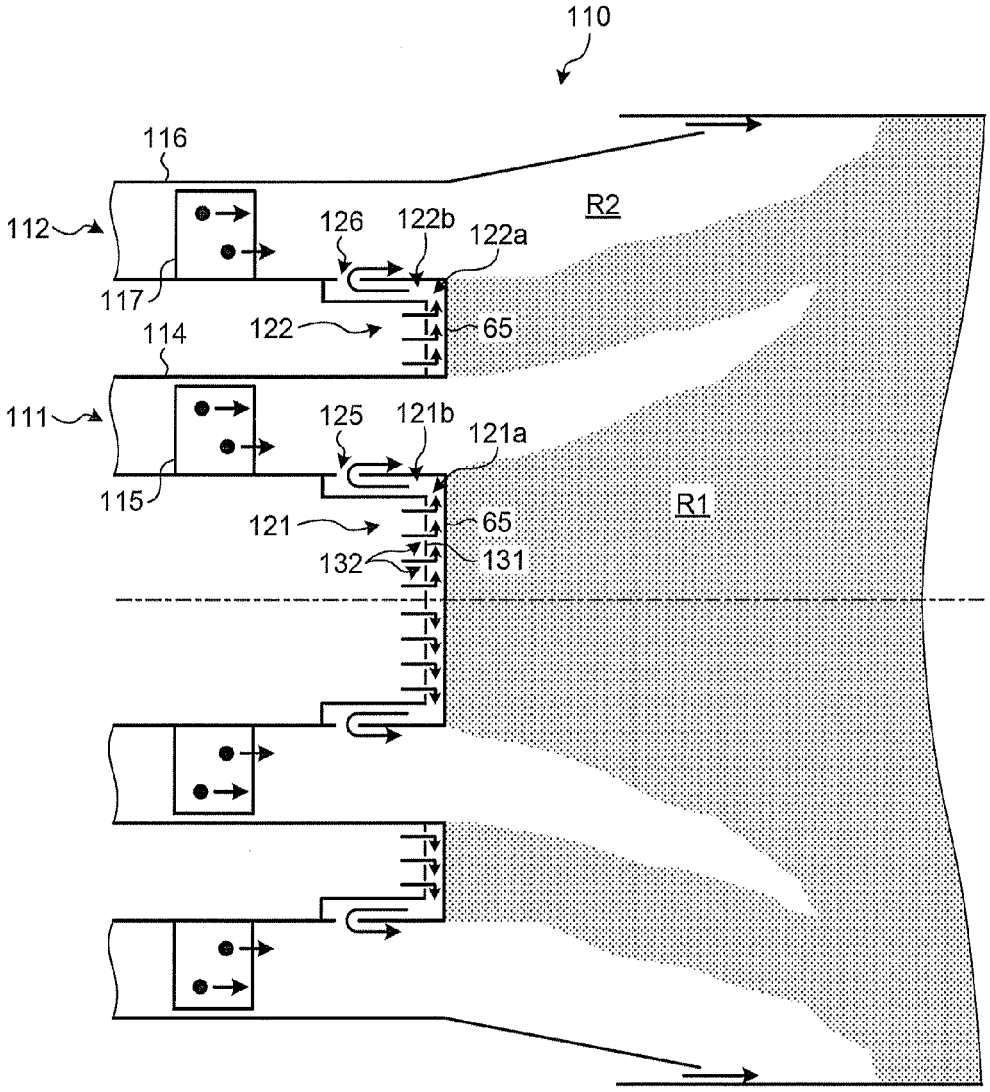
FIG. 7 is a schematic diagram of the configuration around a cooling passage of a burner in a gas turbine combustor according to an exemplary variation of the third embodiment.

Note that the inside cooling passage 121 and outside cooling passage 122 in the third embodiment may be provided as illustrated in FIG. 7 in an exemplary variation. FIG. 7 is a schematic diagram of the configuration around the cooling passage of the burner in the gas turbine combustor according to the exemplary variation of the third embodiment. As illustrated in FIG. 7, an impingement member 131 is inserted in each of the inside cooling passage 121 and the outside cooling passage 122. A plurality of impingement holes 132 is formed on the impingement member 131. Each of the impingement holes 132 penetrates the impingement member 131 such that the cooling air jets and hits the back-step surface 65. In the inside cooling passage 121, the cooling air flows into the upstream inside cooling passage 121*a* of the inside cooling passage 121 after passing through the impingement member 131. Similarly, in the outside cooling passage 122, the cooling air flows into the upstream outside cooling passage 122*a* of the outside cooling passage 122 after passing though the impingement member 131.

The configuration enables the cooling air that passes in the inside cooling passage 121 and the outside cooling passage 122 to jet and hit the inner surface of the back-step surface 65 by causing the cooling air to pass through the impingement member 131. Thus, the configuration can preferably cool the back-step surface 65. The configuration can accelerate the cooling air after the cooling air has passed through the impingement hole 132 and can improve the efficiency of cooling the back-step surface 65. Thus, the configuration can reduce the amount of air to be used as the cooling air.

Fourth Embodiment

Figure 8:
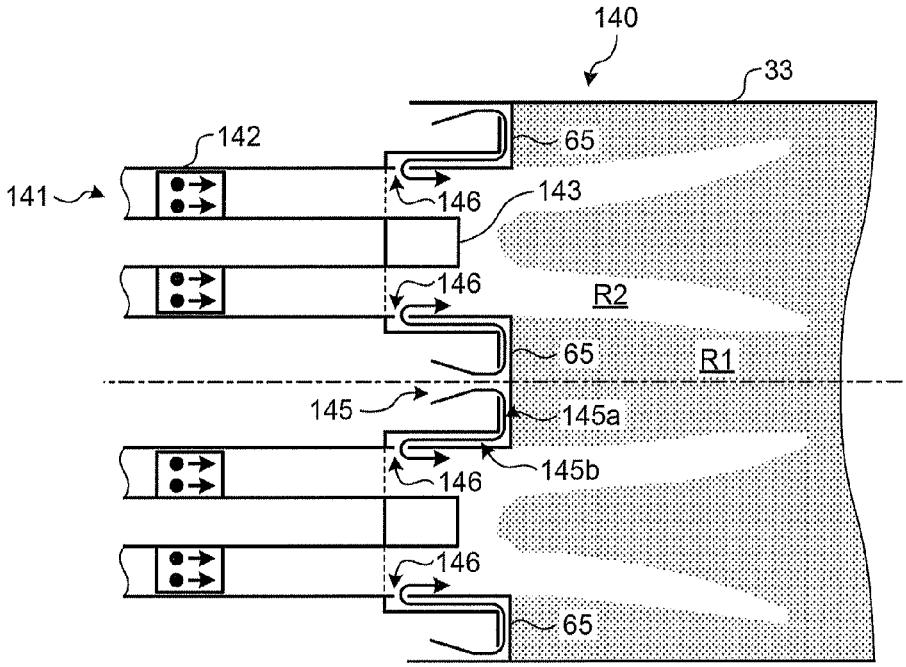
FIG. 8 is a schematic diagram of the configuration around a cooling passage of a burner in a gas turbine combustor according to a fourth embodiment.

A gas turbine combustor 140 according to the fourth embodiment will be described next with reference to FIG. 8. FIG. 8 is a schematic diagram around the cooling passage of the burner of the gas turbine combustor according to the fourth embodiment. Note that only the components different from the first embodiment will be described also in the fourth embodiment in order to avoid the description overlapping with the description in the first embodiment. The gas turbine combustor 12 in the first embodiment is provided with the main burners 50 around the pilot burner 40. On the other hand, the gas turbine combustor 110 in the fourth embodiment is provided with a plurality of burners 141 circumferentially at predetermined intervals around a central axis S.

As illustrated in FIG. 8, in the gas turbine combustor 140 according to the fourth embodiment, a burner 141 includes a burner cylinder 142, and a fuel nozzle 143 placed inside the burner cylinder 142 and in parallel to the central axis S. The fuel is supplied to the fuel nozzle 143 through a main fuel line (not illustrated). The fuel nozzle 143 further functions as a swirler that generates a swirling flow.

The compressed air flows into the burner cylinder 142 of the burner 141. After flowing in the burner cylinder 142, the compressed air is mixed with the fuel ejected from the fuel nozzle 143, and then flows as the swirling flow of the premixed gas from the burner cylinder 142 into the transition piece 33. Thus, the burner cylinder 142 functions as a premixed gas supply passage for supplying the premixed gas toward the transition piece 33. The premixed gas from the burner cylinders 142 of the burners 141 is ignited with a pilot light (not illustrated) and burns, and then jets as the combustion gas into the transition piece 33.

As illustrated in FIG. 8, an unburned gas region R2 in which the premixed gas does not burn is formed on the downstream side of the burner cylinder 142. A combustion region R1 in which the premixed gas burns includes a region from the downstream side of the back-step surface 65 that connects the top end portions 57*b* of the burner cylinders 142 to the inside of the transition piece 33.

In the combustor 140 described above, the film air flows along the inner circumferential surface of the burner cylinder 142. Thus, a film air supply port 146 is provided on the inner circumferential surface of the burner cylinder 142. The film air supply port 146 is a slit opening that opens on the inner circumferential surface and is formed into a slit shape. A cooling passage 145 that cools the back-step surface 65 is connected to the film air supply port 146.

The cooling passage 145 includes an upstream cooling passage 145*a* and a downstream cooling passage 145*b*. The upstream cooling passage 145*a* includes a cooling passage lies along the surface (inner surface) of the inside (the opposite side) of the back-step surface 65 on the inner circumferential side of the central axis S, and a cooling passage lies along the surface (inner surface) of the inside (the opposite side) of the back-step surface 65 on the outer circumferential side of the central axis S. Thus, in the upstream cooling passage 145*a*, the cooling air flows from the central side of the central axis S toward the burner cylinder 142, and flows from the outer circumferential side of the central axis S toward the burner cylinder 142. The downstream cooling passage 145*b* lies along the outer circumferential surface of the burner cylinder 142 such that the cooling air flows therein from the top end toward base end of the burner cylinder 142. In that case, the film air supply port 146 is connected to the downstream cooling passage 145*b*.

A part of the compressed air in the casing 34 flows as the cooling air into the cooling passage 145 described above. The cooling air flows along the inner surface of the back-step surface 65 on the inner and outer circumferential sides of the central axis S by flowing in the upstream cooling passage 145*a*. The flow cools the back-step surface 65. Then, the cooling air flows along the outer circumferential surface of the burner cylinder 142 by flowing in the downstream cooling passage 145*b*. The flow cools the inner circumferential surface of the burner cylinder 142. Subsequently, the cooling air is discharged as the film air from the film air supply port 146 connected to the downstream cooling passage 145*b*.

After being discharged from the film air supply port 146, the film air flows along the inner circumferential surface of the burner cylinder 142, and joins the premixed gas flowing in the burner cylinder 142 downstream of the film air supply port 146.

As described above, the gas turbine combustor 140 having the configuration according to the fourth embodiment can also use the cooling air as the film air. The usage can reduce the amount of air to be used in comparison with the case in which separate airs are used for the cooling air and the film air. The reduction can increase the amount of air to be used as the fuel air. The increase can decrease the concentration of the fuel component in the premixed gas. This can cool the surface facing the combustion region R1, namely, the back-step surface 65 and the like while preventing the flashback and can reduce NOx generated by the combustion of the premixed gas.

Figure 9:
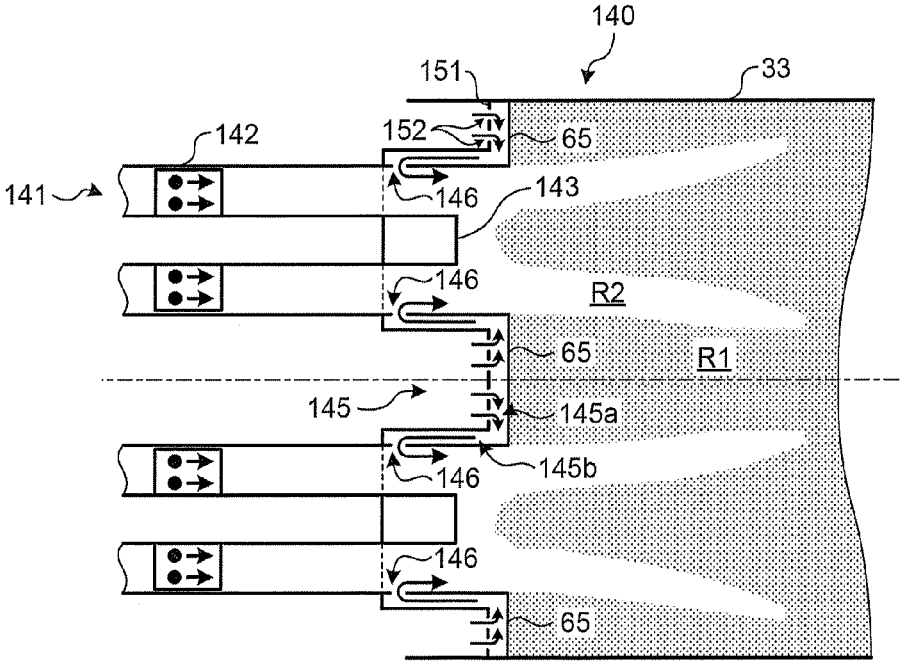
FIG. 9 is a schematic diagram of the configuration around a cooling passage of a burner in a gas turbine combustor according to an exemplary variation of the fourth embodiment.

Note that the cooling passage 145 provided in the fourth embodiment may be provided as illustrated in FIG. 9 in an exemplary variation. FIG. 9 is a schematic diagram of the configuration around the cooling passage of the burner in the gas turbine combustor according to the exemplary variation of the fourth embodiment. As illustrated in FIG. 9, an impingement member 151 is inserted in the cooling passage 145. A plurality of impingement holes 152 is formed on the impingement member 151. Each of the impingement holes 152 penetrates the impingement member 151 such that the cooling air jets and hits the back-step surface 65. In the cooling passage 145, the cooling air flows into the upstream cooling passage 145*a* of the cooling passage 145 after passing through the impingement member 151.

The configuration enables the cooling air that flows in the cooling passage 145 to jet and hit the inner surface of the back-step surface 65 by causing the cooling air to pass through the impingement member 151. Thus, the configuration can preferably cool the back-step surface 65. The configuration can accelerate the cooling air after the cooling air has passed through the impingement hole 152 and can improve the efficiency of cooling the back-step surface 65. The configuration can reduce the amount of air to be used as the cooling air.

REFERENCE SIGNS LIST

1 Gas turbine
11 Compressor

12 Gas turbine combustor
13 Turbine
14 Exhaust chamber
16 Compressor casing
20 Turbine casing
23 Exhaust diffuser
24 Rotor
27 Casing housing
31 External cylinder
32 Inner cylinder
33 Transition piece
34 Casing
40 Pilot burner
41 Pilot cone
42 Pilot nozzle
43 Pilot swirler
50 Main burner
51 Burner cylinder
52 Main nozzle
54 Fuel port
56 First burner cylinder
57 Second burner cylinder
61 Film air supply port
65 Back-step surface
71 Cooling passage
100 Gas turbine combustor (the second embodiment)
105 Main burner (the second embodiment)
106 Burner cylinder (the second embodiment)
110 Gas turbine combustor (the third embodiment)
111 Inside burner
112 Outside burner
114 Inside cylinder
115 Inside fuel nozzle
116 Outside cylinder
117 Outside fuel nozzle
121 Inside cooling passage
122 Outside cooling passage
125 Inside film air supply port
126 Outside film air supply port
131 Impingement member
132 Impingement hole
140 Gas turbine combustor (the fourth embodiment)
141 Burner
142 Burner cylinder
143 Fuel nozzle
145 Cooling passage
146 Film air supply port
151 Impingement member
152 Impingement hole
S Central axis
R1 Combustion region
R2 Unburned gas region

The invention claimed is:

1. A gas turbine combustor that forms therein a combustion region by burning a premixed gas obtained by mixing a fuel and combustion air in advance, the gas turbine combustor comprising:

a plurality of premixed gas supply passages in which the premixed gas passes;

a wall portion formed perpendicular to a central axis of the gas turbine combustor to connect between end portions of the plurality of premixed gas supply passages so as to separate the plurality of premixed gas supply passages;

a film air supply port that is provided on each of the plurality of premixed gas supply passages and that supplies a film air formed into a film shape along an inner wall surface of each of the premixed gas supply passages; and a cooling passage in which a cooling air passes to cool the inner wall surface of each of the premixed gas supply passages and the wall portion facing the combustion region, wherein an outlet side of the cooling passage is connected to the film air supply port, and wherein the cooling passage includes, in a flow direction of the cooling air, an upstream cooling passage formed along an inner surface disposed across the inner wall surface from the combustion region and a downstream cooling passage formed along an inner surface of each of the premixed gas supply passages.

2. The gas turbine combustor according to claim 1, wherein an impingement member is inserted in the cooling passage and the impingement member includes an impingement hole penetrating the impingement member such that the cooling air is injected onto the inner surface.

3. The gas turbine combustor according to claim 1, wherein the film air supply port is an opening formed between the inner wall surface on an upstream side of each of the premixed gas supply passages and the inner wall surface on a downstream side provided outside the inner wall surface on the upstream side.

4. The gas turbine combustor according to claim 1, wherein the film air supply port is a slit opening formed on the inner wall surface of each of the premixed gas supply passages.

5. A gas turbine comprising:

the gas turbine combustor according to claim 1; and a turbine that rotates by a combustion gas generated by combustion of the premixed gas in the gas turbine combustor.

* * * * *